United States Patent [19]

Hitzelberger

[11] Patent Number: 4,563,134

[45] Date of Patent: Jan. 7, 1986

[54] CYLINDER HEAD WITH PRESSURE REGULATOR VALVE

[75] Inventor: Alan L. Hitzelberger, Grand Blanc, Mich.

[73] Assignee: General Motors Corporation, Detroit, Mich.

[21] Appl. No.: 748,177

[22] Filed: Jun. 24, 1985

[51] Int. Cl.[4] ..... F04B 49/02

[52] U.S. Cl. ..... 417/295

[58] Field of Search ..... 417/295, 298, 307, 311

[56] References Cited

U.S. PATENT DOCUMENTS

| | | | |
|---|---|---|---|
| 2,961,147 | 11/1960 | Osterkamp | 417/295 X |
| 3,578,883 | 5/1971 | Cheney | 417/295 X |
| 4,392,347 | 7/1983 | Shows | 417/295 X |

*Primary Examiner*—Richard E. Gluck

*Attorney, Agent, or Firm*—Saul Schwartz

[57] ABSTRACT

A cylinder head assembly for a boost pump of the type having a reciprocating piston pumping gas from an inlet chamber in the cylinder head to a discharge chamber in the cylinder head, the cylinder head assembly further including a flexible diaphragm dividing a cavity of the cylinder head into an inlet control chamber and a feedback chamber, a valve element on the diaphragm operative to throttle air flow through an inlet passage between the inlet control chamber and the inlet chamber, a spring in the inlet control chamber biasing the diaphragm away from the inlet passage, and conduits or passages for conducting inlet air at the above-ambient inlet pressure to the inlet control chamber and air at boost pump discharge pressure to the feedback chamber so that boost pump discharge pressure increases until the latter exceeds the inlet pressure by an amount proportional to the force of the spring.

3 Claims, 3 Drawing Figures

CYLINDER HEAD WITH PRESSURE REGULATOR VALVE

FIELD OF THE INVENTION

This invention relates generally to gas compressors and, more particularly, to a cylinder head assembly for such compressors incorporating an inlet control whereby a constant difference is maintained between the discharge pressure of the compressor and a variable above-ambient inlet pressure.

DESCRIPTION OF THE PRIOR ART

Various gas compressor applications exist wherein the compressor functions as a boost pump to boost the pressure of a gas from an above-ambient inlet pressure to a discharge pressure. In gas turbine engines, for example, where a stream of transport air operates to convey fuel to the combustor or a stream of atomizing air operates to atomize fuel in a nozzle in the combustor, it is necessary to boost the pressure of the transport or atomizing air to a level above the combustion air pressure in the combustor which, typically, is the discharge pressure of the engine's compressor. A convenient source of inlet air for the boost pump is engine compressor discharge air at compressor discharge pressure. It has also been found advantageous to maintain a constant difference between boost pump discharge pressure and compressor discharge pressure even as compressor discharge pressure varies. In one proposed application where powdered coal is entrained in a stream of transport air, a differential pressure regulator valve in an inlet conduit between compressor discharge and the boost pump inlet throttles the inlet flow to the pump to maintain the constant difference between boost pump discharge pressure and engine compressor discharge pressure while improving efficiency by avoiding bleeding of air already elevated to boost pump discharge pressure. A new and improved cylinder head assembly according to this invention incorporates an inlet throttling type differential pressure regulating valve in a particularly compact, efficient and economical structure and, therefore, represents an improvement over heretofore known boost pump cylinder head assemblies.

SUMMARY OF THE INVENTION

The primary feature, then, of this invention is that it provides a new and improved cylinder head assembly for a boost pump compressor whereby a constant difference is maintained between boost discharge pressure and a variable above-ambient inlet pressure. Other features of this invention reside in the provision in the new and improved cylinder head assembly of a cylinder head body having inlet and discharge chambers and one-way valves between the inlet and discharge chambers and a pumping chamber whereby gas is drawn into and expelled from the variable volume pumping chamber above a piston, a flexible diaphragm dividing a cavity of the cylinder head body into an inlet control chamber and a feedback chamber, a valve element on the diaphragm operative to throttle air flow through an inlet passage between the inlet control chamber and the inlet chamber, a spring in the inlet control chamber biasing the diaphragm away from the inlet passage, and conduits or passages for conducting inlet air at the above-ambient inlet pressure to the inlet control chamber and air at boost pump discharge pressure to the feedback chamber so that boost pump discharge pressure increases until the latter exceeds the inlet pressure by an amount proportional to the force of the spring on the diaphragm whereupon equilibrium is established across the diaphragm at a position thereof wherein throttled inlet flow through the inlet passage is just sufficient to maintain the pressure difference.

These and other features of this invention will be readily apparent from the following specification and from the drawings wherein.

Figure 1:
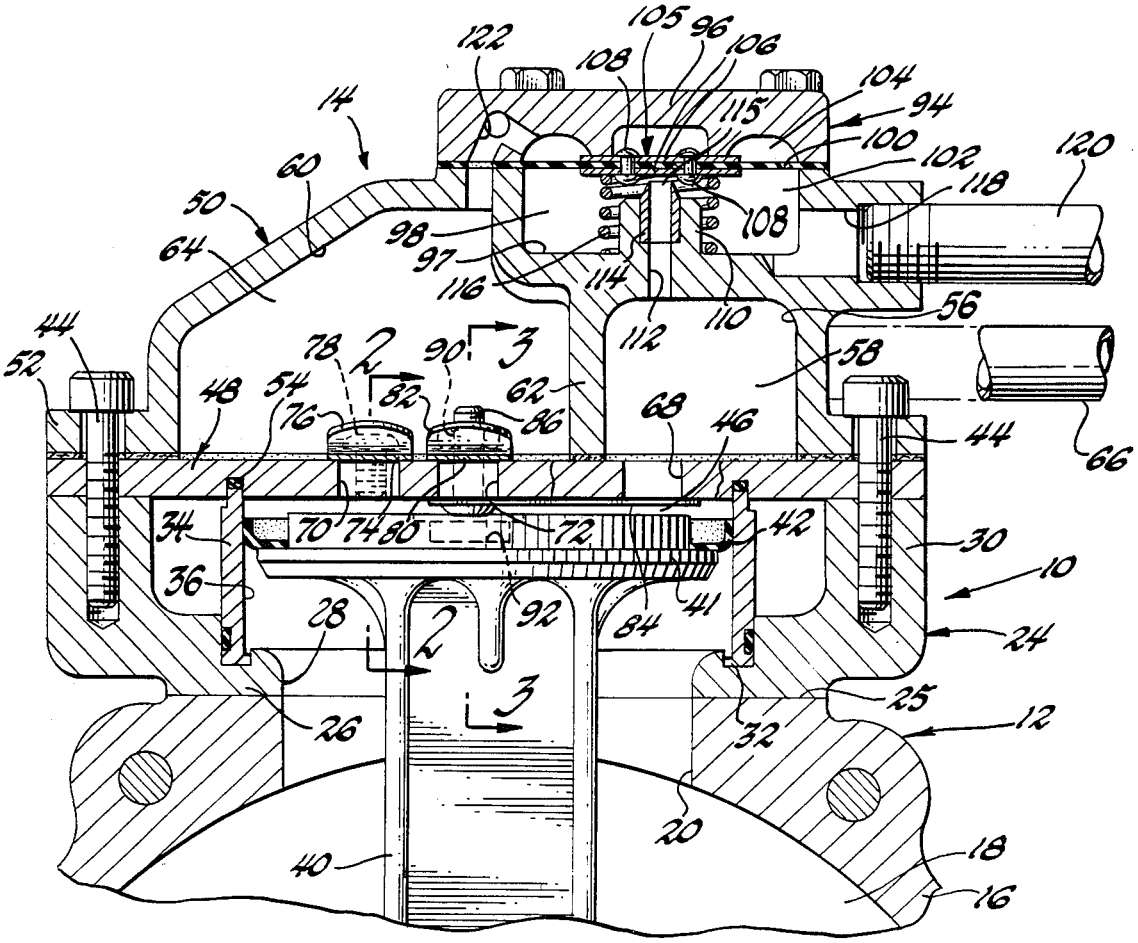
FIG. 1 is a partial sectional view of a boost pump having a cylinder head assembly according to this invention.
Figure 2:
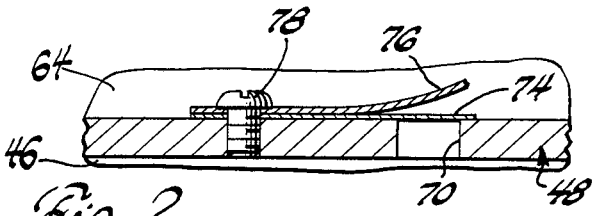
FIG. 2 is an enlarged sectional view taken generally along the plane indicated by line 2—2 in FIG. 1.
Figure 3:
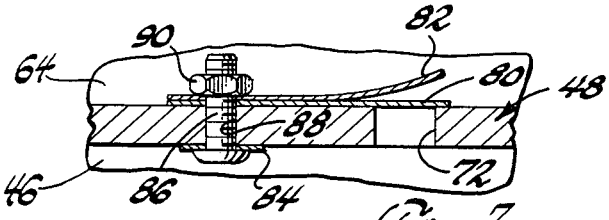
FIG. 3 is an enlarged sectional view taken generally along the plane indicated by line 3—3 in FIG. 1.

Referring now to FIG. 1 of the drawings, a fragmentarily illustrated gas compressor 10, hereinafter referred to as boost pump 10 to avoid confusion with mechanisms such as gas turbine engine compressors, includes a cylinder block 12 and a cylinder head assembly 14 according to this invention. The cylinder block 12 has a crankcase portion 16 with a relatively large internal chamber 18 open vertically through a throat 20. The cylinder block 12 also has a generally square cylinder support 24 seated on an upper surface 25 of the crankcase portion above the throat 20, the cylinder support 24 being bolted to the crankcase portion 16 to define a rigid assembly. The cylinder support 24 has a flat base 26 with a clearance opening 28 therein aligned with the throat 20 and an upstanding peripheral flange 30 integral with and extending completely around the flat base 26. A circular groove 32 is formed in the base 26 of the cylinder support 24 and receives therein a cylinder 34 having an internal cylindrical surface 36.

The boost pump 10 further includes a rod 40 projecting through the throat 20 and clearance opening 28 into the cylinder 34. The rod, at its lower end in the chamber 18, is connected to a crank shaft, not shown, whereby the rod is vertically reciprocated. A piston 41 is formed integrally on the upper end of the rod 40 within the cylinder 34 and has a circular seal 42 thereon which slidably and sealingly engages the internal surface 36 of the cylinder. In conventional fashion, the piston 41 reciprocates in an intake or downward stroke and in an upward or exhaust stroke. The cylinder head assembly 14 according to this invention, disposed over the open end of cylinder 34 and bolted to the peripheral flange 30 of the cylinder support 24 by a plurality of fasteners 44, cooperates with the cylinder 34 and the piston 41 in defining a variable volume pumping chamber 46 above the piston.

With continued reference to FIG. 1, the cylinder head assembly 14 includes a base plate 48 of the same peripheral configuration as the cylinder support 24 and a cylinder head body 50 having a peripheral flange 52 extending therearound. The fasteners 44 extend through appropriate clearance bores in the flange 52 and through registered bores in the base plate 48 into threaded bores in the peripheral flange 30 of the cylinder support 24. Accordingly, the base plate 48 is captured between the cylinder head body 50 and the cylinder support 24 and the cylinder head assembly 14 is rigidly fastened to the cylinder block 12. The base plate 48 has a circular groove 54 therein which receives the upper end of cylinder 34 whereby the cylinder is rigidly supported between the cylinder block 12 and the cylinder head assembly 14.

The cylinder head body 50 is conveniently fabricated by conventional casting techniques and includes a first cavity 56 which cooperates with the base plate 48 in defining a closed inlet chamber 58. Similarly, the cylinder head body 50 includes a second cavity 60 separated from the first cavity 56 by a partition 62 and cooperating with the base plate 48 in defining a discharge chamber 64. A discharge port, not shown, in the cylinder head body 50 communicates with the discharge chamber 64 and is adapted for attachment of a fragmentarily illustrated discharge conduit 66 whereby compressed gas at a pump discharge pressure in the discharge chamber 64 is conveyed to an appropriate device such as an air atomizing fuel nozzle in a combustor of a gas turbine engine.

The base plate 48 has an inlet bore 68 therethrough between the inlet chamber 58 and the pumping chamber 46. Similarly, the base plate has a pair of discharge bores 70 and 72 therethrough between the discharge chamber 64 and the pumping chamber 46. A first flexible reed 74 having a normal flat configuration, is disposed on the upper surface of the base plate 48 within the discharge chamber 64 with a first end overlying the discharge bore 70 and a second end captured between a curved limiting plate 76 and the base plate 48. A screw or similar fastener 78 clamps the limiting plate 76 and the corresponding end of the flexible reed 74 against the base plate 48. Similarly, a second flexible reed 80, having a normal flat configuration, is disposed on the same surface of the base plate 48 within the discharge chamber 64 with one end overlying the second discharge bore 72 and the other end captured between the base plate 48 and a second curved limiting plate 82. On the opposite side of the base plate 48, a third flexible reed 84, having a normal flat configuration, is disposed perpendicular to the second flexible reed 80 with one end underlying the inlet bore 68 and the other end underlying the registered ends of the second reed 80 and the second limiting plate 82. The head of a screw or like fastener 86 projecting through an aperture 88 in the base plate 48 clamps the end of the third flexible reed 84 remote from the inlet bore 68 against the base plate while a nut 90 on the screw clamps the registered ends of the second limiting plate 82 and the second flexible reed 80 against the opposite side of the base plate.

The third flexible reed 84 defines a one-way valve between the inlet chamber 58 and the pumping chamber 46. The first and second flexible reeds 74 and 80 define parallel one-way valves between the discharge chamber 64 and the pumping chamber 46. When the piston 41 moves downward during an intake stroke, the pressure differential between the expanding pumping chamber 46 and the inlet chamber 58 flexes the third reed 84 downward allowing passage of gas from the inlet chamber to the pumping chamber. Simultaneously, the pressure difference between the pumping chamber and the discharge chamber 64 holds the first and second flexible reeds 74 and 80 tightly over the discharge bores 70 and 72, respectively, preventing backflow of gas from the discharge chamber into the pumping chamber. When the piston 41 moves upward during an exhaust stroke, the pressure differential reverses so that the third flexible reed 84 is pressed tightly over the inlet bore 68 to prevent backflow to the inlet chamber 58 while the first and second flexible reeds 74 and 80 bend upward against the limiting plates 76 and 82, respectively, to permit passage of gas from the pumping chamber 46 into the discharge chamber 64. A depression 92 in the piston 41 provides clearance for the head of the screw 86 when the piston is in its uppermost position.

The cylinder head assembly 14 further includes a differential pressure regulator valve portion 94 which throttles inlet flow to the pump to maintain a constant difference between pump discharge pressure in discharge chamber 64 and a variable above-ambient inlet pressure in inlet chamber 58 regardless of inlet pressure variation. More particularly, a cap 96 bolted to the cylinder head body 50 cooperates with a generally annular depression 97 in the latter in defining a cavity 98. A flexible diaphragm 100 captured between the cylinder head body 50 and the cap 96 divides the cavity 98 into an inlet control chamber 102 below the diaphragm and exposed to the lower side thereof and a feedback chamber 104 above the diaphragm and exposed to the upper side thereof. A valve element 105 on the flexible diaphragm 100 is defined by a pair of flat plates 106 on opposite sides of the diaphragm clamped together by a plurality of rivets 108 with the diaphragm therebetween. The valve element 105 moves up and down as the diaphragm 100 flexes.

The pressure regulator valve portion 94 further includes a generally cylindrical boss 110 on the cylinder head body 50 within the inlet control chamber 102 through which extends an inlet passage 112 communicating between the inlet chamber 58 and the inlet control chamber 102. A cylindrical valve seat 114 is pressed into the boss 110 over the inlet passage 112 such that an upper edge 115 of the valve seat 114 is disposed in close proximity to the valve element 105 on the diaphragm. A coil spring 116 is disposed in the inlet control chamber 102 around the boss 110 and bears at one end against the cylinder head body 50 and at the other end against the valve element 105. The spring 116 biases the valve element and the diaphragm upward to provide clearance between the upper edge 115 of the valve seat 114 and the valve element 105. An inlet port 118 in the cylinder head body 50 provides communication between the inlet control chamber 102 and a conduit 120 through which gas, typically air, at a variable above-ambient inlet pressure is introduced into the inlet control chamber. A feedback passage 122 extends through the cylinder head body 50 and the cap 96 from the discharge chamber 64 to the feedback chamber 104 whereby gas at pump discharge pressure prevailing in the discharge chamber 64 is directed to the feedback chamber 104.

In a typical operating sequence beginning with the conduit 120 charged with gas at an above-ambient inlet pressure and the piston 41 stationary, gas at inlet pressure circulates through the port 118, the inlet control chamber 102 and the inlet passage 112 into the inlet chamber 58 due to the bias of spring 116 holding the valve element 105 away from the upper edge 115 of the valve seat 114. When power is supplied to reciprocate the piston 41 in the cylinder 34, gas from inlet chamber 58 is pumped to discharge chamber 64 through the one-way valves defined by the flexible reeds 84, 80 and 74. Downstream flow obstructions cause the gas pressure in discharge chamber 64 to increase as pumping action continues. Simultaneously, gas at pump discharge pressure is conveyed to feedback chamber 104 above the flexible diaphragm 100 urging the diaphragm downward against the opposing force of spring 116 and gas at inlet pressure.

Inlet flow through the inlet passage 112 remains effectively unrestricted as long as upward force on the lower side of the diaphragm 100 created by the spring 116 and inlet pressure in inlet control chamber 102 substantially exceeds the opposing force of pump discharge pressure in feedback chamber 104. With inlet flow unrestricted, pump discharge pressure increases until the downward force created thereby on the diaphragm begins moving the latter downward causing the valve element 105 to approach the upper edge 115 of valve seat 114 and throttle the inlet flow of gas through the inlet passage 112. As inlet flow is progressively throttled, the pump discharge pressure increases at a slower rate until static equilibrium is established across the diaphragm with inlet flow through inlet passage 112 just sufficient to maintain pump discharge pressure in excess of inlet pressure by an amount corresponding to the force exerted by spring 116. In the event that inlet pressure in inlet control chamber 102 increases, the flexible diaphragm 100 moves upward allowing increased flow through the inlet passage 112 and a corresponding increase in pump discharge pressure until equilibrium is once again established with pump discharge pressure exceeding the inlet pressure by the same predetermined difference. Likewise, if inlet pressure decreases, pump discharge pressure in feedback chamber 104 momentarily forces the flexible diaphragm downward so that the valve element 105 further throttles inlet gas flow through the inlet passage 112 thereby causing a decrease in pump discharge pressure in discharge chamber 64. Pump discharge pressure continues to decrease until equilibrium is once again established across the flexible diaphragm with pump discharge pressure exceeding inlet pressure by the same predetermined difference.

The embodiments of the invention in which an exclusive property or privilege is claimed are defined as follows:

1. In a boost pump for providing gas at a pump discharge pressure which exceeds a variable above-ambient inlet pressure of said gas from a gas source by a constant absolute pressure difference, said boost pump including a piston disposed in a cylinder for reciprocation in intake and exhaust strokes, a cylinder head assembly comprising, a cylinder head body cooperating with said cylinder and with said piston in defining a variable volume pumping chamber, means on said cylinder head body defining an inlet chamber, first one-way valve means between said inlet and said pumping chambers open only during said piston intake strokes, second one-way valve means between said discharge and said pumping chambers open only during said piston exhaust strokes, means on said cylinder head body defining a cavity, a flexible diaphragm on said cylinder head body dividing said cavity into an inlet control chamber exposed to one side of said diaphragm and a feedback chamber exposed to the opposite side of said diaphragm, means defining an inlet passage between said inlet control chamber and said inlet chamber, a valve element on said diaphragm, means connecting said gas source to said inlet control chamber so that said gas at said inlet pressure urges said diaphragm and said valve element away from said inlet passage thereby to allow gas flow to said inlet chamber, spring means urging said diaphragm and said valve element away from said inlet passage with a spring force proportional to said constant absolute pressure difference, and means defining a feedback passage between said discharge chamber and said feedback chamber whereby gas at said pump discharge pressure urges said diaphragm and said valve element toward said inlet passage so that gas flow through said inlet passage is progressively throttled, said pump discharge pressure increasing until static equilibrium is established across said diaphragm with gas flow through said inlet passage throttled by an amount just sufficient to maintain said pump discharge pressure in excess of said inlet pressure by said constant absolute pressure difference.

2. The boost pump recited in claim 1 further including a boss on said cylinder head body in said inlet control chamber through which said inlet passage extends, and a cylindrical valve seat disposed on said boss around an end of said inlet passage, said valve seat cooperating with said valve element on said diaphragm in defining a variable orifice through which gas flow is throttled in accordance with movement of said diaphragm and said valve element toward and away from said inlet passage.

3. The boost pump recited in claim 2 wherein said spring means is a coil spring disposed in said inlet control chamber around said boss in compression between said cylinder head body and said valve element on said diaphragm.

* * * * *